US007211610B2

(12) United States Patent
Takesue et al.

(10) Patent No.: US 7,211,610 B2
(45) **Date of Patent: *May 1, 2007**

(54) GOLF BALL MATERIALS AND GOLF BALL

(75) Inventors: Rinya Takesue, Chichibu (JP); Yasushi Ichikawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/188,712

(22) Filed: Jul. 26, 2005

(65) Prior Publication Data

US 2005/0256269 A1 Nov. 17, 2005

Related U.S. Application Data

(62) Division of application No. 09/695,140, filed on Oct. 25, 2000, now Pat. No. 6,962,951.

(30) Foreign Application Priority Data

Oct. 25, 1999 (JP) ..... 11-302572

(51) Int. Cl.
*A63B 37/12* (2006.01)
*C08K 5/09* (2006.01)

(52) U.S. Cl. ..... 524/322; 524/394; 524/399; 524/400; 473/385

(58) Field of Classification Search ..... None
See application file for complete search history.

(56) References Cited

U.S. PATENT DOCUMENTS

| | | | | |
|---|---|---|---|---|
| 3,404,134 | A | 10/1968 | Rees | |
| 3,959,539 | A | 5/1976 | Waggoner | |
| 4,526,375 | A | 7/1985 | Nakade | |
| 4,984,804 | A | 1/1991 | Yamada et al. | |
| 4,999,404 | A | 3/1991 | Matsuki | |
| 5,019,320 | A | 5/1991 | Hasegawa et al. | |
| 5,298,571 | A | 3/1994 | Staz | |
| 5,306,760 | A | 4/1994 | Sullivan | |
| 5,312,857 | A | 5/1994 | Sullivan | |
| 5,439,227 | A | 8/1995 | Esgashira et al. | |
| 5,559,188 | A | 9/1996 | Esgashira et al. | |
| 5,605,968 | A | 2/1997 | Esgashira et al. | |
| 5,688,595 | A | 11/1997 | Yamagishi et al. | |
| 5,733,205 | A | 3/1998 | Higuchi et al. | |
| 5,779,561 | A | 7/1998 | Sullivan et al. | |
| 5,803,831 | A | 9/1998 | Sullivan et al. | |
| 5,824,740 | A | 10/1998 | Yabuki et al. | |
| 5,830,085 | A | 11/1998 | Yamagishi et al. | |
| 5,830,086 | A | 11/1998 | Hayashi et al. | |
| 5,902,855 | A | 5/1999 | Sullivan | |
| 5,929,189 | A | 7/1999 | Ichikawa et al. | |
| 5,948,859 | A | 9/1999 | Sano et al. | |
| 5,952,415 | A | 9/1999 | Hwang | |
| 5,967,908 | A | 10/1999 | Yamagishi et al. | |
| 5,976,443 | A | 11/1999 | Nesbitt et al. | |
| 5,994,470 | A | 11/1999 | Tanaka et al. | |
| 6,018,003 | A | 1/2000 | Sullivan et al. | |
| 6,034,182 | A | 3/2000 | Kashiwagi et al. | |
| 6,100,321 | A | 8/2000 | Chen | |
| 6,245,858 | B1 | 6/2001 | Sullivan | |
| 6,319,153 | B1 | 11/2001 | Nesbitt et al. | |
| 6,325,731 | B1 | 12/2001 | Kennedy, III et al. | |
| 6,329,458 | B1 | 12/2001 | Takesue et al. | |
| 6,419,594 | B1 | 7/2002 | Nesbitt et al. | |
| 6,565,455 | B2 * | 5/2003 | Hayashi et al. | 473/371 |
| 6,653,382 | B1 * | 11/2003 | Statz et al. | 524/400 |
| 6,838,501 | B2 * | 1/2005 | Takesue et al. | 524/394 |
| 6,894,097 | B2 * | 5/2005 | Takesue et al. | 524/322 |
| 6,962,951 | B1 * | 11/2005 | Takesue et al. | 524/322 |
| 2002/0055400 | A1 | 5/2002 | Higuchi et al. | |
| 2002/0061793 | A1 | 5/2002 | Higuchi et al. | |
| 2002/0091188 | A1 * | 7/2002 | Statz et al. | 524/400 |

FOREIGN PATENT DOCUMENTS

| | | |
|---|---|---|
| GB | 1 113 409 | 5/1968 |
| GB | 2 278 609 | 12/1994 |
| JP | 5-3931 | 1/1993 |
| JP | 9-117532 | 5/1997 |
| JP | 9-313643 | 12/1997 |
| JP | 10-127818 | 5/1998 |
| JP | 10-305114 | 11/1998 |
| WO | WO 98/46671 | 10/1998 |
| WO | WO 00/23519 | 4/2000 |
| WO | WO 01/29129 | 4/2001 |

* cited by examiner

*Primary Examiner*—David J. Buttner
(74) *Attorney, Agent, or Firm*—Sughrue Mion, PLLC

(57) ABSTRACT

A golf ball material comprises a heated mixture having a melt index of at least 1.0 dg/min, which mixture is composed of (A) a thermoplastic resin, (B) a fatty acid or fatty acid derivative having a molecular weight of at least 280, and (C) a basic inorganic metal compound capable of neutralizing acidic groups in components A and B. The material including a highly neutralized ionomer resin has good thermal stability, flow characteristics and moldability. The invention is also directed at high-rebound golf balls which can be easily and efficiently manufactured using the same material.

12 Claims, No Drawings

GOLF BALL MATERIALS AND GOLF BALL

This is a divisional of application Ser. No. 09/695,140 filed Oct. 25, 2000, now U.S. Pat. No. 6,962,951, the entire disclosure of which is incorporated herein by reference.

The present invention relates to highly neutralized ionomer resin-containing golf ball materials which have good thermal stability, flow characteristics and moldability, and which are capable of providing high-performance golf balls endowed with outstanding rebound energy. The invention relates also to golf balls made with such golf ball materials.

BACKGROUND OF THE INVENTION

Over the past few years, wide use has been made of ionomer resins in golf ball cover materials, also referred to hereinafter as "cover stock." Ionomer resins are ionic copolymers composed of an olefin such as ethylene in combination with an unsaturated carboxylic acid such as acrylic acid, methacrylic acid or maleic acid, wherein the acidic groups are partially neutralized with metal ions such as sodium, lithium, zinc or magnesium ions. They have excellent characteristics such as durability, rebound and scuff resistance, making them highly suitable as the base resin in golf ball cover stock.

Ionomer resins account for most of the cover stock resin in current use and enable the production of golf balls having the above properties. However, golfers are always on the lookout for golf balls having a high rebound and excellent flight characteristics.

Related improvements taught by the prior art (see U.S. Pat. No. 5,312,857, U.S. Pat. No. 5,306,760, and International Application WO 98/46671) include cover stock in which a large amount of metallic soap is added to the ionomer resin to improve the cost and rebound characteristics of the ionomer cover stock. Such modifications have indeed resulted in better rebound than earlier golf balls with ionomer covers.

However, because a large amount of metallic soap is added to the ionomer resin in this prior-art cover stock, the fatty acids that form due to decomposition of the metallic soap vaporize during injection molding, generating a large amount of gas. The formation of a large amount of gas during injection molding causes molding defects. In addition, gas constituents settle on the surface of the molded article and greatly lower the paintability of the molded article. Moreover, although such cover stock in which a large amount of metallic soap has been added to the ionomer resin does exhibit a rebound which is about the same as or better than that of ionomer having the same degree of hardness, the improvement in rebound is not all that large. Indeed, depending on the type of metallic soap used, the moldability and rebound may in fact be severely compromised and fall far short of practical levels.

SUMMARY OF THE INVENTION

Therefore, one object of the invention is to provide highly neutralized ionomer resin-containing golf ball materials which have good thermal stability, flow characteristics and moldability, and which are capable of providing high-performance golf balls of outstanding rebound. Another object of the invention is to provide golf balls made using such golf ball materials.

Accordingly, the invention provides a golf ball material comprising a heated mixture having a melt index of at least 1.0 dg/min which is composed of:

(A) 100 parts by weight of a base resin comprising one or a mixture of
  (A1) an olefin-unsaturated carboxylic acid random copolymer or an olefin-unsaturated carboxylic acid-unsaturated carboxylate random copolymer or both, and
  (A2) a metal ion-neutralized olefin-unsaturated carboxylic acid random copolymer or a metal ion-neutralized olefin-unsaturated carboxylic acid-unsaturated carboxylate random copolymer or both;
(B) 5 to 80 parts by weight of a fatty acid or fatty acid derivative having a molecular weight of at least 280; and
(C) 0.1 to 10 parts by weight of a basic inorganic metal compound capable of neutralizing acidic groups in components A and B.

Component A2 is preferably a zinc-neutralized ionomer resin.

The fatty acid or fatty acid derivative of component B typically has from 18 to 80 carbon atoms per molecule, and is preferably selected from among stearic acid, behenic acid, arachidic acid, lignoceric acid and derivatives thereof.

The basic inorganic metal compound of component C is preferably magnesium oxide.

The heated mixture, when subjected to infrared absorption spectroscopy, preferably has an absorption peak attributable to carboxylate anion stretching vibrations at 1530 to 1630 $cm^{-1}$ and an absorption peak attributable to carbonyl stretching vibrations at 1690 to 1710 $cm^{-1}$, such that carboxylate anion peak absorbance is at least 1.5 times greater than carbonyl peak absorbance. When subjected to thermogravimetric analysis, the heated mixture preferably has a weight loss at 250° C. of at least 2% based on the weight at 25° C.

Generally, at least 70 mol % of the acid groups in the heated mixture are neutralized with metal ions typically comprised of at least one type of transition metal ion and at least one type of alkali metal or alkaline earth metal ion, the transition metal ions and the alkali metal or alkaline earth metal ions preferably having a molar ratio of from 10:90 to 90:10. Preferably, the transition metal ions are zinc ions, and the alkali metal or alkaline earth metal ions are at least one type selected from among sodium ions, lithium ions, calcium ions and magnesium ions.

In another aspect, the invention provides a one-piece golf ball made from the foregoing golf ball material.

The invention additionally provides a solid golf ball comprising a solid core of at least one layer and a cover of at least one layer enclosing the solid core, wherein at least one layer of the solid core or the cover is made of the foregoing golf ball material. Typically, the solid golf ball comprises either a one-layer cover enclosing the solid core, wherein the cover is made of the foregoing golf ball material, or a cover of at least two layers enclosing the solid core, wherein at least one inner cover layer other than the outermost cover layer is made of the foregoing golf ball material.

The invention further provides a thread-wound golf ball comprising a thread-wound core composed of a solid center of one or more layers or a liquid center made of a liquid-filled center envelope, about which solid or liquid center has been wound a rubber thread, and a cover of one or more layers which encloses the thread-wound core; wherein the solid center or at least one layer of the cover is made of the above-described golf ball material. Preferably, the thread-wound core is either enclosed within a one-layer cover made of the above-described golf ball material, or is enclosed within a cover having two or more layers, of which at least one inner layer other than the outermost layer is made of the above-described golf ball material.

DETAILED DESCRIPTION OF THE INVENTION

The golf ball material of the invention contains, as the base resin, (A1) an olefin-unsaturated carboxylic acid random copolymer and/or an olefin-unsaturated carboxylic acid-unsaturated carboxylate random copolymer, (A2) a metal ion-neutralized olefin-unsaturated carboxylic acid random copolymer and/or a metal ion-neutralized olefin-unsaturated carboxylic acid-unsaturated carboxylate random copolymer, or a combination of both components A1 and A2.

Generally, the olefin in component A1 has at least 2 carbons, but not more than 8 carbons, and preferably not more than 6 carbons. Illustrative examples include ethylene, propylene, butene, pentene, hexene, heptene and octene. Ethylene is especially preferred.

Suitable examples of the unsaturated carboxylic acid include acrylic acid, methacrylic acid, maleic acid and fumaric acid. Of these, acrylic acid and methacrylic acid are especially preferred.

The unsaturated carboxylate is preferably a lower alkyl ester of the foregoing unsaturated carboxylic acid. Illustrative examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer of component A1may be prepared by using a known process to carry out random copolymerization on the above ingredients. It is generally recommended that the unsaturated carboxylic acid content within the random copolymer be at least 2% by weight, preferably at least 6% by weight, and most preferably at least 8% by weight, but not more than 25% by weight, preferably not more than 20% by weight, and most preferably not more than 15% by weight. A low acid content may lower the resilience of the material, whereas a high acid content may lower the processability of the material.

The neutralized random copolymer serving as component A2 of the invention may be prepared by partially neutralizing acid groups in the above-mentioned random copolymer with metal ions. Examples of metal ions which may neutralize the acid groups include $Na^+$, $K^+$, $Li^+$, $Zn^2$+, $Cu^{2+}$, $Mg^{2+}$, $Ca^{2+}$, $Co^{2+}$, $Ni^{2+}$and $Pb^{2+}$. The use of ions such as $Na^+$, $Li^+$, $Zn^{2+}$ and $Mg^{2+}$ is preferred. $Zn^{2+}$ is especially preferred.

The degree of random copolymer neutralization by these metal ions is not critical. Such neutralized random copolymers may be prepared using a method known to the art. For example, the metal ions can be introduced onto the random copolymer using formates, acetates, nitrates, carbonates, hydrogencarbonates, oxides, hydroxides or alkoxides of the metal ions.

Illustrative examples of the random copolymer serving as component A1 include Nucrel AN4311, AN4318 and AN1560. (all produced by DuPont-Mitsui Polychemicals Co., Ltd.). Illustrative examples of the neutralized random copolymer serving as component A2 include Himilan 1554, 1557, 1601, 1605, 1706, 1855, 1856 and AM7316 (all products of DuPont-Mitsui Polychemicals Co., Ltd.); and also Surlyn 6320, 7930 and 8120 (all products of E.I. DuPont de Nemours and Company). Zinc-neutralized ionomer resins, such as Himilan AM7316, are especially preferred.

As already noted, the base resin used in the invention may be a random copolymer of the type described above for component A1, a neutralized random copolymer of the type described above for component A2, or a combination of both. Where both types of component are used in combination, the proportions in which they are blended are not subject to any particular limitations.

Component B of the invention is a fatty acid or fatty acid derivative having a molecular weight of at least 280 whose purpose is to enhance the flow characteristics of the heated mixture. It has a molecular weight which is much smaller than that of the thermoplastic resin of component A1, and greatly increases the melt viscosity of the mixture. Also, because the fatty acid or fatty acid derivative has a molecular weight of at least 280 and has a high content of acid groups or derivative moieties thereof, its addition to the golf material results in little if any loss of rebound.

The fatty acid or fatty acid derivative of component B used in the inventive golf ball material may be an unsaturated fatty acid or fatty acid derivative thereof having a double bond or triple bond in the alkyl group, or it may be a saturated fatty acid or fatty acid derivative in which all the bonds on the alkyl group are single bonds. It is recommended that the number of carbon atoms on the molecule generally be at least 18, but not more than 80, and preferably not more than 40. Too few carbons may make it impossible to achieve the improved heat resistance which is an object of the invention, and may also set the acid group content so high as to cause the acid groups to interact with acid groups present on the base resin, diminishing the flow-improving effects. On the other hand, too many carbons increases the molecular weight, which may also lower the flow-improving effects.

Specific examples of fatty acids that may be used as component B include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

Fatty acid derivatives which may be used as component B include derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^+$, $Ca^{2+}$, $Mg^{2+}$, $Zn^{2+}$, $Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are especially preferred.

Specific examples of fatty acid derivatives that may be used as component B include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Moreover, use may also be made of known metallic soap-modified ionomers, including those described in U.S.

Pat. No. 5,312,857, U.S. Pat. No. 5,306,760 and WO 98/46671, in combination with above components A1 and/or A2 and component B.

The golf ball material of the invention includes as component C a basic inorganic filler capable of neutralizing the acid groups in components A1 and/or A2 and in component B. As already noted in the preamble, heating and mixing only components A1 and/or A2 and component B, and especially only a metal-modified ionomer resin (e.g., only a metallic soap-modified ionomer resin of the type described in the above-cited patents), results in fatty acid formation due to an exchange reaction between the metallic soap and unneutralized acid groups on the ionomer, as shown below.

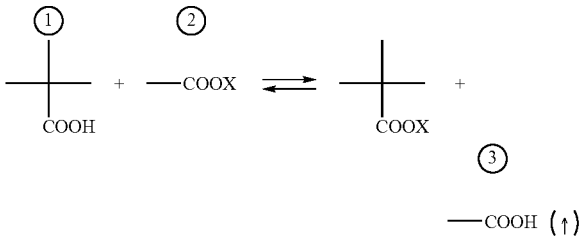

Here, (1) is an unneutralized acid group present on the ionomer resin, (2) is a metallic soap, (3) is a fatty acid, and X is a metal atom.

Because the fatty acid which forms has a low thermal stability and readily vaporizes during molding, this causes molding defects. In addition, the fatty acid which has thus formed settles on the surface of the molded article, substantially lowering the ability of a paint film to adhere thereto.

In order to resolve such problems, the present invention includes as component C a basic inorganic metal compound which neutralizes the acid groups present in above components A1 and/or A2 and in component B. Incorporating component C serves to neutralize the acid groups in components A1 and/or A2 and in component B. These components, when blended together, act synergistically to increase the thermal stability of the heated mixture. In addition, the blending of these components imparts a good processability and makes it possible to enhance the rebound as a golf ball material.

Component C is a basic inorganic metal compound capable of neutralizing the acid groups in components A1 and/or A2 and component B. The use of a monoxide is especially advisable. High reactivity with the ionomer resin and the absence of organic compounds in the reaction by-products enable the degree of neutralization of the heated mixture to be increased without a loss of thermal stability.

Exemplary metal ions that may be used in the basic inorganic metal compound include $Li^+$, $Na^+$, $K^+$, $Ca^{2+}$, $Mg^{2+}$, $Zn^{2+}$, $Al^{3+}$, $Ni^+$, $Fe^{2+}$, $Fe^{3+}$, $Cu^{2+}$, $Mn^{2+}$, $Sn^{2+}$, $Pb^{2+}$ and $Co^{2+}$. Examples of suitable inorganic metal compounds include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As already noted, a monoxide is preferred. The use of magnesium oxide having a high reactivity with the ionomer resin is especially preferred.

The inventive golf ball material comprising, as described above, components A1 and/or A2, in combination with component B and component C has improved thermal stability, processability and rebound. It is critical that the components be compounded in relative proportions of 100 parts by weight of component A1 and/or component A2 as the base resin; at least 5 but not more than 80 parts by weight, preferably not more than 40 parts by weight, and most preferably not more than 20 parts by weight, of component B; and at least 0.1 but not more than 10 parts by weight, and preferably not more than 5 parts by weight, of component C. Too little component B lowers the melt viscosity, resulting in inferior processability, whereas too much detracts from the durability. Too little component C fails to improve thermal stability and rebound, whereas too much component C instead lowers the heat resistance of the composition due to the presence of excess basic inorganic metal compound.

The heated mixture of the invention may be arrived at by either using the above-described material as is or by suitably compounding therein other materials. In either case, the melt index of the heated mixture, as measured in accordance with JIS-K6760 at a temperature of 190° C. and under a load of 21 N (2.16 kgf), must be at least 1.0 dg/min, and is preferably at least 1.5 dg/min, and most preferably at least 2.0 dg/min. It is recommended that the melt index be not more than 20 dg/min, and preferably not more than 15 dg/min. If the heated mixture has too low a melt index, the processability decreases markedly.

The heated mixture of the invention is preferably characterized in terms of the relative absorbance in infrared absorption spectroscopy, representing the ratio of absorbance at the absorption peak attributable to carboxylate anion stretching vibrations normally detected at 1530 to 1630 $cm^{-1}$ to the absorbance at the absorption peak attributable to carbonyl stretching vibrations normally detected at 1690 to 1710 $cm^{-1}$. For the sake of clarity, this ratio may be expressed as follows: (absorbance of absorption peak for carboxylate anion stretching vibrations)/(absorbance of absorption peak for carbonyl stretching vibrations).

Here, "carboxylate anion stretching vibrations" refers to vibrations by carboxyl groups from which the proton has dissociated (metal ion-neutralized carboxyl groups), whereas "carbonyl stretching vibrations" refers to vibrations by undissociated carboxyl groups. The ratio in these respective peak intensities depends on the degree of neutralization. In the ionomer resins having a degree of neutralization of about 50 mol % which are commonly used, the ratio between these peak absorbances is about 1:1.

To improve the thermal stability, moldability and rebound of the golf ball material, it is recommended that the heated mixture in the invention have a carboxylate anion stretching vibration peak absorbance which is at least 1.5 times, and preferably at least 2 times, the carbonyl stretching vibration peak absorbance. The absence of a carbonyl stretching vibration peak altogether is especially preferred.

The thermal stability of the inventive golf ball material can be measured by thermogravimetry. It is recommended that, in thermogravimetric analysis, the heated mixture have a weight loss at 250° C., based on the weight of the mixture at 25° C., of not more than 2% by weight, preferably not more than 1.5% by weight, and most preferably not more than 1% by weight.

The heated mixture may have any desired specific gravity although it is generally advisable for the specific gravity to be at least 0.9, but not more than 1.5, preferably not more than 1.3 and most preferably not more than 1.1.

While the golf ball material of the invention is arrived at by heating and mixing above components A1 and/or A2 with components B and C so as to optimize the melt index, it is recommended that at least 70 mol %, preferably at least 80 mol %, and most preferably at least 90 mol %, of the acid groups in the heated mixture be neutralized. Much neutralization makes it possible to more reliably suppress the exchange reaction which becomes a problem on account of the high degree of neutralization when only the above-described base resin and the fatty acid or fatty acid derivative are used, and thus prevents the formation of fatty acid. As a result, there can be obtained a material of greatly increased thermal stability and good moldability which has a much larger resilience than prior-art ionomer resins.

To more reliably achieve both a high degree of neutralization and good flow characteristics, it is recommended that neutralization of the heated mixture in the invention involve neutralization of the acid groups in the heated mixture with transition metal ions and alkali metal and/or alkaline earth metal ions. Because transition metal ions have weaker ionic cohesion than alkali metal and alkaline earth metal ions, the use of transition metal ions to neutralize some of the acid groups in the heated mixture can provide a substantial improvement in the flow characteristics.

The molar ratio between the transition metal ions and the alkali metal and/or alkaline earth metal ions may be adjusted as appropriate, although a ratio within a range of from 10:90 to 90:10 is preferred, and a ratio of from 20:80 to 80:20 is especially preferred. Too low a molar ratio of transition metal ions may fail to provide sufficient improvement in the flow characteristics of the golf ball material. On the other hand, too high a molar ratio may lower the resilience.

Specific examples of the metal ions include zinc ions as the transition metal ions, and at least one type of ion selected from among sodium ions, lithium ions and magnesium ions as the alkali metal or alkaline earth metal ions.

No particular limitation is imposed on the method used to obtain a heated mixture in which the acid groups have been neutralized with transition metal ions and alkali metal or alkaline earth metal ions. For example, specific methods of neutralization with transition metal ions, and in particular zinc ions, include the use of zinc soap as the fatty acid derivative, the inclusion of a zinc-neutralized polymer (e.g., zinc-neutralized ionomer resin) as component A2, and the use of zinc oxide as the basic inorganic metal compound of component C.

As noted above, the golf ball material of the invention can be obtained by using the above-described heated mixture as the essential composition and incorporating therein whatever additives may be required. For example, where the material is to be used as a cover stock, the heated mixture may have added thereto such additives as pigments, dispersants, antioxidants, ultraviolet absorbers and light stabilizers. To improve the feel of the golf ball when struck with a golf club, the inventive material may include, in addition to the above essential components, various types of non-ionomer thermoplastic elastomers, examples of which include olefin-based elastomers, styrene-based elastomers, ester-based elastomers and urethane-based elastomers. Of these, the use of olefin-based elastomers and styrene-based elastomers is especially preferred.

The method for preparing the material of the invention is not subject to any particular limitations. For instance, when the inventive material is prepared for use as cover stock in the manufacture of golf balls, heating is typically carried out at a temperature of 150 to 250° C. and blending is typically carried out using an internal mixer such as a kneading-type twin-screw extruder, a Banbury mixer or a kneader. Any suitable method may be used without particular limitation to incorporate various additives together with the essential components in the golf ball material of the invention. For example, the additives may be blended with the essential components, and heating and mixing of all the ingredients carried out at the same time. Alternatively, the essential components may be pre-heated and pre-mixed, following which the optional additives may be added and the overall composition subjected to additional heating and mixing.

The golf balls of the invention are golf balls which have been produced using a golf ball material according to the invention. The layer or layers made of the golf ball material may constitute part or all of the golf ball. The inventive golf balls may be thread-wound balls, including those in which the cover has a single-layer or a multiple-layer construction, one-piece balls, two-piece balls, three-piece balls, or multi-piece balls having a cover composed of three or more layers.

The inventive golf balls may be manufactured by preparing various heated mixtures for making one-piece balls, the solid centers of thread-wound golf balls, the solid cores of solid golf balls, or cover stock (for at least on layer in cores and covers composed of two or more layers) in accordance with the above-described golf ball material formulation of the invention, then using the heated mixture in accordance with a golf ball manufacturing method known to the art.

When the cover of a golf ball according to the invention is made of the golf ball material according to the present invention, the core may be a thread-wound core or a solid core and may be produced by a conventional method. For example, a solid core may be produced by preparing a rubber composition composed of 100 parts by weight of cis-1,4-polybutadiene; from 10 to 60 parts by weight of one or more vulcanizing or crosslinking agents selected from among $\alpha,\beta$-monoethylenically unsaturated carboxylic acids (e.g., acrylic acid, methacrylic acid) or metal ion-neutralized compounds thereof and functional monomers (e.g., trimethylolpropane methacrylate); from 5 to 30 parts by weight of a filler such as zinc oxide or barium sulfate; from 0.5 to 5 parts by weight of a peroxide such as dicumyl peroxide; and, if necessary, from 0.1 to 1 part by weight of an antioxidant. The resulting rubber composition can be formed into a solid spherical core by press vulcanization to effect crosslinkage, followed by compression under heating (140 to 170° C.) for a period of 10 to 40 minutes.

Production of a thread-wound golf ball core may be carried out using either a liquid or a solid center. In the case of a liquid center, a hollow spherical center envelope may be formed from the above-described rubber composition, for example, and a liquid filled into this envelope by a well-known method. If a solid center is used instead, the solid center may be produced by the solid core production method described above. Thereafter, rubber thread is wound in a stretched state about the center to form the core.

Use may be made of rubber thread produced by a conventional method. For example, a rubber composition is prepared by compounding natural rubber or synthetic rubber such as polyisoprene with various additives (e.g., antioxidants, vulcanization accelerators and sulfur), extruded and vulcanized.

The golf balls using the various types of cores described above and falling within the scope of the invention can be produced by forming the cover from the inventive golf ball material. In one such method, a single-layer or multi-layer core prefabricated according to the type of ball to be manufactured is placed in a mold, and the inventive material is heated, mixed and melted, then injection-molded over the core. In this case, the golf ball manufacturing operation can be carried out under conditions which assure that the material maintain excellent thermal stability, flow characteristics and moldability. The resulting golf ball has a high rebound.

The method used to produce the cover is not limited to the method described above. For example, use may be made of a method in which first a pair of hemispherical cups is molded from the inventive golf ball material, following which the cups are placed over a core and molded under heat (120 to 170° C.) and pressure for 1 to 5 minutes.

No particular limitation is imposed on the thickness of the cover made of the inventive material, although generally the cover is formed to a thickness of at least 1 mm, and preferably at least 1.3 mm, but not more than 4 mm, and preferably not more than 2.3 mm. The cover in the golf balls of the invention is not limited to one layer, and may instead have a multilayer construction of two or more layers. If the cover has a multilayer construction, the golf ball material of the invention may be used either at the interior of the multilayer construction or as the outermost layer of the cover. If the inventive gold ball has a single-layer cover, it is highly advantageous for the inventive material to serve as the cover material. If the ball has a cover of two or more layers, the inventive material is most preferably used as a layer of the cover other than the outermost layer—that is, as an inner layer of the cover.

The surface of the outermost layer of the cover may have a plurality of dimples formed thereon, and the cover may be administered various treatment such as surface preparation, stamping and painting. In particular, the ease of work involved in administering such surface treatment to a golf ball cover made of the inventive material can be improved by the good processability of the cover surface.

In the golf balls manufactured as described above, the diameter, weight, hardness and other parameters of the cover, solid or liquid center, solid core or thread-wound core, and one-piece golf balls, while not subject to any particular limitations, may be adjusted as appropriate, insofar as the objects of the invention are attainable.

The golf ball of the invention may be a golf ball in which the inventive golf ball material has been used other than as the cover stock described above. For example, it may be a golf ball arrived at by using the inventive material as a one-piece golf ball material or as a core material, in which case production may be carried out by injection-molding the material.

The golf ball of the invention may be manufactured for use in tournaments by giving it a diameter and weight which conform with the Rules of Golf. That is, the ball may be produced to a diameter of at least 42.67 mm and a weight of not more than 45.93 g.

The golf ball material of the invention includes a highly neutralized ionomer resin and has good thermal stability, flow characteristics and moldability. The golf balls of the invention, which are arrived at by making use of the inventive golf ball material, can be manufactured easily and efficiently, and have excellent rebound.

EXAMPLE

Examples of the invention and comparative examples are given below by way of illustration, and are not intended to limit the invention.

Examples 1–5 and Comparative Examples 1–14

Using a core material composed primarily of cis-1,4-polybutadiene, a solid core was produced having a diameter of 38.6 mm, a weight of 35.1 g, and a deflection of 3.1 mm under a load of 100 kg.

Cover materials of the compositions shown in Tables 1 and 2 were mixed at 200° C. with a kneading-type twin-screw extruder and prepared in the form of pellets. In each of the examples, the cover material was injected into a mold in which the solid core prepared above had been placed, giving a two-piece solid golf ball having a diameter of 42.8 mm and a cover thickness of 2.1 mm.

Example 6 and Comparative Examples 15 and 16

Using a core material composed primarily of cis-1,4-polybutadiene, a solid core was produced having a diameter of 36.8 mm, a weight of 30.4 g, and a deflection of 3.1 mm under a load of 100 kg.

In Example 6, the cover material described above in Example 1 was injection-molded over the core so as to form an inner cover layer having a thickness of 1.5 mm. Similarly, in Comparative Examples 15 and 16, the respective cover materials described in Comparative Examples 3 and 4 were injection-molded over the core so as to form in each case an inner cover layer having a thickness of 1.5 mm. Next, in each of the three examples, the outer cover material shown in Table 3 was injection-molded over the inner cover layer, thereby giving a three-piece golf ball having a diameter of 42.8 mm.

The following characteristics were measured or evaluated for the golf balls obtained in each of the above examples. The results are shown in Tables 1 to 3.

Ball Hardness:

Measured as the deflection (in millimeters) of the ball under a load of 100 kg.

Initial Velocity:

Measured using the same type of initial velocity instrument as that used by the United States Golf Association (USGA), and in accordance with USGA rules.

Relative Absorbance of Carboxylate Anion Absorption Peak:

A transmission method was used to measure the infrared absorption of the samples. In the infrared absorption spectrum for a sample prepared to such a thickness as to make the peak transmittance associated with hydrocarbon chains observed near 2900 $cm^{-1}$ about 90%, the absorption peak due to carbonyl stretching vibrations (1690 to 1710 $cm^{-1}$) was assigned an absorbance value of 1 and the ratio thereto of the absorption peak due to carboxylate anion strength vibrations (1530 to 1630 $cm^{-1}$) was computed as the relative absorbance.

Percent Weight Loss:

Prior to measurement, samples were dried in a dry hopper at 50° C. for 24 hours for eliminating the influence of moisture. Thermogravimetric analysis was carried out on approximately 5 mg samples by raising the temperature from 25° C. to 300° C. in a nitrogen atmosphere (flow rate, 100 ml/min) at a rate of 10° C./min, then calculating the percent loss in the sample weight at 250° C. relative to the sample weight at 25° C.

Degree of Neutralization:

Of all the acid groups (including acid groups on fatty acids or fatty acid derivatives) present in the heated mixture, the mole fraction of acid groups neutralized with metal ions was computed from the acid content, degree of neutralization, and molecular weight of the starting materials.

Compounding Ratio of Transition Metal Ions:

The mole fraction of transition metal ions among the metal ions which neutralize the acid groups present on the heated mixture was computed from the acid content, degree of neutralization and molecular weight of the starting materials.

Melt Index:

The melt flow rate of the material was measured in accordance with JIS-K6760 at a temperature of 190° C. and under a load of 21 N (2.16 kgf).

Extrudability:

Each of the cover materials was rated as follows for its processability when worked at 200° C. in an intermeshing co-rotating type twin-screw extruder (screw diameter, 32 mm; main motor output, 7.5 kW) such as is commonly used for mixing materials.

Good: Extrudable

Poor: Cannot be Extruded Due to Excess Loading

Trade names and materials mentioned in the tables are described below.

Nucrel AN4318: An ethylene-methacrylic acid-acrylate copolymer made by DuPont-Mitsui Polychemicals Co., Ltd. Acid content, 8 wt %. Ester content, 17 wt %.

Nucrel 1560: An ethylene-methacrylic acid copolymer made by DuPont-Mitsui Polychemicals Co., Ltd. Acid content, 15 wt %.

Himilan AM7316: A three-component zinc ionomer produced by DuPont-Mitsui Polychemicals Co., Ltd. Acid content, 10 wt %. Degree of neutralization, 50 mol %. Ester content, 24 wt %.

Surlyn 6320: A three-component magnesium ionomer produced by E.I. DuPont de Nemours and Company. Acid content, 10 wt %. Degree of neutralization, 50 mol %. Ester content, 24 wt %.

Himilan AM7311: A magnesium ionomer produced by DuPont-Mitsui Polychemicals Co., Ltd. Acid content, 15 wt %. Degree of neutralization, 54 mol %.

Behenic acid: Produced by NOF Corporation under the trade name NAA-222S.

Magnesium oxide: A highly active type of magnesium oxide produced by Kyowa Chemical Industry Co., Ltd. under the trade name Micromag 3-150.

Himilan 1706: A zinc ionomer produced by DuPont-Mitsui Polychemicals Co., Ltd. Acid content, 15 wt %. Degree of neutralization, 59 mol %.

Himilan 1605: A sodium ionomer produced by DuPont-Mitsui Polychemicals Co., Ltd. Acid content, 15 wt %. Degree of neutralization, 29 mol %.

TABLE 1

| | | | Example | | | | | Comparative Example | | | | |
|---|---|---|---|---|---|---|---|---|---|---|---|---|
| | | | 1 | 2 | 3 | 4 | 5 | 1 | 2 | 3 | 4 | 5 |
| Composition (pbw) | Component A1 | Nucrel AN4318 | 100 | 100 | 50 | | | 100 | 100 | | | 50 |
| | | Nucrel 1560 | | | | | 50 | | | | | |
| | Component A2 | Himilan AM7316 | | | 50 | 100 | 50 | | | | | 50 |
| | | Surlyn 6320 | | | | | | | | 100 | 80 | |
| | | Himilan AM7311 | | | | | | | | | 20 | |
| | Component B | Behenic acid | 20 | | 20 | 20 | 20 | | | | | |
| | | Magnesium stearate | | 20 | | | | | 20 | 20 | | |
| | Component C | Magnesium oxide | 3.0 | 1.5 | 2.3 | 1.6 | 2.4 | 3.0 | | | | 3.0 |
| | Titanium dioxide | | 2 | 2 | 2 | 2 | 2 | 2 | 2 | 2 | 2 | 2 |
| Resin Properties | Extrudability | | good | good | good | good | good | poor | good | good | good | poor |
| | Degree of neutralization (mol %) | | 98 | 88 | 88 | 79 | 73 | 100 | 42 | 68 | 51 | 100 |
| | Transition metal ion compounding ratio | | 0 | 0 | 20 | 42 | 20 | 0 | 0 | 0 | 0 | 16 |
| | Melt index (dg/min) | | 1.6 | 1.6 | 2.0 | 2.5 | 4.5 | — | 32.0 | 2.5 | 0.9 | — |
| | Weight loss (wt %) | | 0.6 | 1.2 | 0.8 | 1.2 | 1.5 | — | 1.6 | 2.5 | 1.2 | — |
| | Relative absorbance of carboxylate peak | | 2.6 | 2.3 | 2.3 | 2.1 | 1.8 | — | 0.8 | 1.5 | 1.1 | — |
| | Cover hardness(Shore D) | | 50 | 50 | 50 | 50 | 54 | — | 31 | 50 | 50 | — |
| | Specific gravity | | 0.97 | 0.97 | 0.97 | 0.97 | 0.97 | — | 0.97 | 0.97 | 0.97 | — |
| Ball Properties | Weight (g) | | 45.2 | 45.2 | 45.2 | 45.2 | 45.2 | — | 45.2 | 45.2 | 45.2 | — |
| | Hardness (mm) | | 2.82 | 2.82 | 2.82 | 2.82 | 2.79 | — | 3.02 | 2.82 | 2.82 | — |
| | Initial velocity (m/s) | | 76.3 | 76.2 | 76.3 | 76.3 | 76.4 | — | 75.8 | 76.1 | 75.9 | — |

TABLE 2

| | | | Comparative Example | | | | | | | | |
|---|---|---|---|---|---|---|---|---|---|---|---|
| | | | 6 | 7 | 8 | 9 | 10 | 11 | 12 | 13 | 14 |
| Composition (pbw) | Component A1 | Nucrel AN4318 | 50 | | | | | | | | |
| | | Nucrel 1560 | | | | | | 50 | 50 | | |
| | Component A2 | Himilan AM7316 | 50 | 50 | 50 | 100 | 100 | 50 | 50 | 30 | 50 |
| | | Surlyn 6320 | | 10 | 50 | | | | | | |
| | | Himilan AM7311 | | 40 | | | | | | 70 | 50 |
| | Component B | Behenic acid | | | | | | | | | |
| | | Magnesium stearate | 20 | | 20 | | 20 | | 20 | | 20 |
| | Component C | Magnesium oxide | | | | 3.0 | | 3.0 | | | |
| | Titanium dioxide | | 2 | 2 | 2 | 2 | 2 | 2 | 2 | 2 | 2 |
| Resin Properties | Extrudability | | good | good | good | poor | good | poor | good | good | good |
| | Degree of neutralization (mol %) | | 56 | 52 | 68 | 100 | 68 | 100 | 45 | 53 | 67 |
| | Transition metal ion compounding ratio | | 30 | 40 | 23 | 28 | 46 | 16 | 30 | 21 | 20 |
| | Melt index (dg/min) | | 17.0 | 0.9 | 2.0 | — | 1.5 | — | 31.0 | 0.8 | 2.0 |
| | Weight loss (wt %) | | 1.8 | 1.2 | 2.5 | — | 2.2 | — | 2.5 | 1.2 | 2.5 |
| | Relative absorbance of carboxylate peak | | 1.0 | 1.5 | 1.7 | — | 1.2 | — | 1.0 | 1.7 | 1.7 |
| | Cover hardness(Shore D) | | 34 | 50 | 50 | — | 37 | — | 44 | 54 | 54 |
| | Specific gravity | | 0.97 | 0.97 | 0.97 | — | 0.97 | — | 0.97 | 0.97 | 0.97 |
| Ball Properties | Weight (g) | | 45.2 | 45.2 | 45.2 | — | 45.2 | — | 45.2 | 45.2 | 45.2 |
| | Hardness (mm) | | 2.98 | 2.82 | 2.82 | — | 2.95 | — | 2.88 | 2.79 | 2.79 |
| | Initial velocity (m/s) | | 75.8 | 75.9 | 76.0 | — | 75.8 | — | 75.9 | 76.1 | 76.2 |

TABLE 3

| | | | | Example | Comparative Example | |
|---|---|---|---|---|---|---|
| | | | | 6 | 15 | 16 |
| Inner Cover layer | Composition (pbw) | Component A1 | Nucrel AN4318 | 100 | | |
| | | Component A2 | Surlyn 6320 | | 100 | 80 |
| | | | Himilan AM7311 | | | 20 |
| | | Component B | Behenic acid | 20 | | |
| | | | Magnesium stearate | | 20 | |
| | | Component D | Magnesium oxide | 3 | | |
| | | Titanium dioxide | | 2 | 2 | 2 |
| | Thickness (mm) | | | 1.5 | 1.5 | 1.5 |
| Outer cover layer | Composition (pbw) | Himilan 1706 | | 50 | 50 | 50 |
| | | Himilan 1605 | | 50 | 50 | 50 |
| | | Titanium dioxide | | 2 | 2 | 2 |
| | Thickness (mm) | | | 1.5 | 1.5 | 1.5 |
| | Hardness (Shore D) | | | 62 | 62 | 62 |
| | Specific gravity | | | 0.98 | 0.98 | 0.98 |
| Ball Properties | Weight (g) | | | 45.2 | 45.2 | 45.2 |
| | Hardness (mm) | | | 2.68 | 2.68 | 2.68 |
| | Initial velocity (m/s) | | | 76.6 | 76.4 | 76.2 |

The results of the examples are described below.

In Examples 1 and 2 of the invention, cover stock according to the invention was prepared using as the base resin an ethylene-methacrylic acid-acrylate copolymer. In Comparative Example 1, in which component B was excluded and magnesium oxide was added to the same base resin to a high degree of neutralization, the resin cured during mixture and was thus impossible to mold. In Comparative Example 2 in which component C was excluded and a metallic soap-modified resin of the same base resin was used, the resulting material gave the golf ball less rebound energy than the resins prepared in Examples 1 and 2 of the invention. Moreover, Examples 1 and 2 had excellent thermal stability and rebound compared with Comparative Example 3, in which a metallic soap-modified cover stock of the same hardness was used, and had excellent rebound and flow characteristics compared to Comparative Example 4, in which a magnesium ionomer cover stock of the same hardness was used.

In Example 3 of the invention, a cover stock according to the invention was prepared using as the base resin a mixture of an ethylene-methacrylic acid-acrylate copolymer with a zinc ion-neutralized ethylene-methacrylic acid-acrylate copolymer. In Comparative. Example 5, in which component B was excluded and magnesium oxide was added to the same base resin to a high degree of neutralization, the resin cured during mixture and was thus impossible to mold. In Comparative Example 6, in which component C was excluded and a metallic soap-modified resin obtained from the same base resin was used, the rebound and thermal stability were far inferior to those achieved in Example 3 of the invention. Moreover, the same Example 3 achieved better thermal stability and rebound than in Comparative Example 8, in which component C was excluded and a metallic soap-modified cover stock of the same hardness was used, and achieved a better rebound and flow characteristics than in Comparative Example 7, in which neither component B nor C was included and a zinc/magnesium ionomer cover stock of the same hardness was used.

In Example 4 of the invention, a cover stock according to the invention was prepared using as the base resin a zinc ion-neutralized ethylene-methacrylic acid-acrylate copolymer. In Comparative Example 9, in which component B was excluded and magnesium oxide was added to the same base resin to a high degree of neutralization, the resin cured during mixture and was thus impossible to mold. In Comparative Example 10, in which component C was excluded and a metallic soap-modified resin obtained from the same base resin was used, the rebound and thermal stability were far inferior to those achieved in Example 4 of the invention. Moreover, the same Example 4 achieved a better thermal stability and rebound than in Comparative Example 8, in which and a metallic soap-modified cover stock of the same hardness was used, and achieved a better rebound and flow characteristics than in Comparative Example 7, in which and a zinc/magnesium ionomer cover stock of the same hardness was used.

The cover stocks prepared in Examples 3 and 4 of the invention, in which acid groups within the heated mixture were neutralized with magnesium ions and zinc ions, had a higher melt viscosity than the cover materials prepared in Examples 1 and 2 of the invention, in which the acid groups were neutralized only with magnesium ions.

In Example 5 of the invention, a cover stock according to the invention was prepared using as the base resin a mixture of an ethylene-methacrylic acid copolymer and a zinc ion-neutralized ethylene-methacrylic acid-acrylate copolymer. In Comparative Example 11, in which magnesium oxide was added to the same base resin to a high degree of neutralization, the resin cured during mixture and was thus impossible to mold. In Comparative Example 12, in which a metallic soap-modified resin obtained from the same base resin was used, the rebound and thermal stability were far inferior to those achieved in Example 5 of the invention. Moreover, the same Example 5 achieved a better thermal stability and rebound than in Comparative Example 14, in which a metallic soap-modified cover stock of the same hardness was used, and achieved a better rebound and flow characteristics than in Comparative Example 13, in which neither component B nor C was included and a zinc/magnesium ionomer cover stock of the same hardness was used.

The ball produced in Example 6 of the invention, in which the cover stock of Example 1 was used as an inner cover material, had a much higher rebound than the balls obtained in Comparative Examples 15 and 16, wherein a metallic soap-modified cover stock (cover stock of Comparative Example 3) and an ionomer cover stock (cover stock of Comparative Example 4) were used as the respective inner cover materials.

From the above examples, it is apparent that the golf ball materials of the invention have satisfactory thermal stability, flow characteristics and moldability, and are capable of providing golf balls of excellent rebound energy.

Japanese Patent Application No. 11-302572 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball, comprising a solid core of at least one layer and a cover of at least one layer enclosing the solid core, wherein an outermost layer of a cover is made of a golf ball material comprising a heated mixture having a melt index of at least 1.0 dg/min, consisting essentially of:

(A) 100 parts by weight of a base resin comprising (A1) an olefin-unsaturated carboxylic acid random copolymer or an olefin-unsaturated carboxylic acid-unsaturated carboxylate random copolymer or both;

(B) 5 to 20 parts by weight of a fatty acid or fatty acid derivative having a molecular weight of at least 280; and (C) 0.1 to 10 parts by weight of a basic inorganic metal compound capable of neutralizing acidic groups in components (A) and (B), wherein the fatty acid or fatty acid derivative of component (B) is behenic acid.

2. A golf ball, comprising a solid core of at least one layer and a cover of at least one layer enclosing the solid core, wherein an outermost layer of a cover is made of a golf ball material comprising a heated mixture having a melt index of at least 1.0 dg/min, consisting essentially of:

(A) 100 parts by weight of a base resin comprising a heated mixture of (A1) an olefin-unsaturated carboxylic acid random copolymer or an olefin-unsaturated carboxylic acid-unsaturated carboxylate random copolymer or both, and (A2) a zinc ion-neutralized olefin-unsaturated carboxylic acid random copolymer or a zinc ion-neutralized olefin-unsaturated carboxylic acid-unsaturated carboxylate random copolymer or both;

(B) 5 to 20 parts by weight of a fatty acid or fatty acid derivative having a molecular weight of at least 280; and (C) 0.1 to 10 parts by weight of a basic inorganic metal compound capable of neutralizing acidic groups in components (A) and (B).

3. The golf ball of claim 2, wherein the basic inorganic metal compound of component (C) is selected from the group consisting of calcium oxide, magnesium oxide, sodium hydroxide and calcium hydroxide.

4. The golf ball of claim 2, wherein the basic inorganic metal compound of component (C) is zinc oxide.

5. The golf ball of claim 2, wherein the fatty acid or fatty acid derivative of component (B) is behenic acid.

6. The golf ball of claim 2, wherein the fatty acid or fatty acid derivative of component (B) is magnesium stearate.

7. The golf ball of claim 2, wherein the basic inorganic metal compound of component (C) is magnesium oxide.

8. A golf ball, comprising a solid core of at least one layer and a cover of at least one layer enclosing the solid core, wherein an outermost layer of a cover is made of a golf ball material comprising a heated mixture having a melt index of at least 1.0 dg/min, consisting essentially of:

(A) 100 parts by weight of a base resin comprising (A2) a zinc ion-neutralized olefin-unsaturated carboxylic acid random copolymer or a zinc ion-neutralized olefin-unsaturated carboxylic acid-unsaturated carboxylate random copolymer or both;

(B) 5 to 20 parts by weight of a fatty acid or fatty acid derivative having a molecular weight of at least 280; and (C) 0.1 to 10 parts by weight of a basic inorganic metal compound capable of neutralizing acidic groups in components (A) and (B), wherein the fatty acid or fatty acid derivative of component (B) is behenic acid.

9. A golf ball, comprising a solid core of at least one layer and a cover of at least one layer enclosing the solid core, wherein an outermost layer of a cover is made of a golf ball material comprising a heated mixture having a melt index of at least 1.0 dg/min, consisting essentially of:

(A) 100 parts by weight of a base resin comprising (A1) an olefin-unsaturated carboxylic acid random copolymer or an olefin-unsaturated carboxylic acid-unsaturated carboxylate random copolymer or both;

(B) 5 to 20 parts by weight of a fatty acid or fatty acid derivative having a molecular weight of at least 280; and (C) 0.1 to 10 parts by weight of a basic inorganic metal compound capable of neutralizing acidic groups in components (A) and (B), wherein the basic inorganic metal compound of component (C) is selected from the group consisting of calcium oxide, magnesium oxide, sodium hydroxide and calcium hydroxide, and wherein the fatty acid or fatty acid derivative of component (B) is behenic acid.

10. A golf ball, comprising a solid core of at least one layer and a cover of at least one layer enclosing the solid core, wherein an outermost layer of a cover is made of a golf ball material comprising a heated mixture having a melt index of at least 1.0 dg/min, consisting essentially of:

(A) 100 parts by weight of a base resin comprising (A1) an olefin-unsaturated carboxylic acid random copolymer or an olefin-unsaturated carboxylic acid-unsaturated carboxylate random copolymer or both;

(B) 5 to 20 parts by weight of a fatty acid or fatty acid derivative having a molecular weight of at least 280; and (C) 0.1 to 10 parts by weight of a basic inorganic metal compound capable of neutralizing acidic groups in components (A) and (B), wherein the basic inorganic metal compound of component (C) is zinc oxide, and wherein the fatty acid or fatty acid derivative of component (B) is behenic acid.

11. A golf ball, comprising a solid core of at least one layer and a cover of at least one layer enclosing the solid core, wherein an outermost layer of a cover is made of a golf ball material comprising a heated mixture having a melt index of 1.0 dg/min, consisting essentially of:

(A) 100 parts by weight of a base resin comprising (A2) a zinc ion-neutralized olefin-unsaturated carboxylic acid random copolymer or a zinc ion-neutralized olefin-unsaturated carboxylic acid-unsaturated carboxylate random copolymer or both;

(B) 5 to 20 parts by weight of a fatty acid or fatty acid derivative having a molecular weight of at least 280; and (C) 0.1 to 10 parts by weight of a basic inorganic metal compound capable of neutralizing acidic groups in components (A) and (B), wherein the basic inorganic metal compound of component (C) is selected from the group consisting of calcium oxide, magnesium oxide, sodium hydroxide and calcium hydroxide, and wherein the fatty acid or fatty acid derivative of component (B) is behenic acid.

12. A golf ball, comprising a solid core of at least one layer and a cover of at least one layer enclosing the solid core, wherein an outermost layer of a cover is made of a golf ball material comprising a heated mixture having a melt index of at least 1.0 dg/min, consisting essentially of:

(A) 100 pans by weight of a base resin comprising (A2) a zinc ion-neutralized olefin-unsaturated carboxylic acid random copolymer or a zinc ion-neutralized olefin-unsaturated carboxylic acid-unsaturated carboxylate random copolymer or both;

(B) 5 to 20 parts by weight of a fatty acid or fatty acid derivative having a molecular weight of at least 280; and (C) 0.1 to 10 parts by weight of a basic inorganic metal compound capable of neutralizing acidic groups in components (A) and (B), wherein the basic inorganic metal compound of component (C) is zinc oxide, and wherein the fatty acid or fatty acid derivative of component (B) is behenic acid.

* * * * *